US006422614B1

(12) United States Patent
Kuntz et al.

(10) Patent No.: US 6,422,614 B1
(45) Date of Patent: Jul. 23, 2002

(54) ELECTRONIC LOCK

(75) Inventors: Scott Kuntz, Twinsburg; Paul Hofener, Parma, both of OH (US)

(73) Assignee: Milocon Corporation, Newington, VA (US)

( * ) Notice: Subject to any disclaimer, the term of this patent is extended or adjusted under 35 U.S.C. 154(b) by 0 days.

(21) Appl. No.: 09/565,068

(22) Filed: May 5, 2000

Related U.S. Application Data

(60) Provisional application No. 60/133,872, filed on May 12, 1999.

(51) Int. Cl.[7] ..... E05G 1/06
(52) U.S. Cl. ..... 292/144; 292/171
(58) Field of Search ..... 292/201, 125, 292/141, 144, 171, 225; 70/277, 282; 74/502.6

(56) References Cited

U.S. PATENT DOCUMENTS 2,382,985 A * 8/1945 Gerald ..... 180/82
2,740,285 A * 4/1956 Hugle ..... 70/146
4,325,269 A * 4/1982 Nagano ..... 74/501 R
4,461,160 A * 7/1984 Van Gompel ..... 70/100
5,307,707 A * 5/1994 Roelle ..... 74/502.6
5,353,626 A * 10/1994 Davidson ..... 74/502.6
5,386,713 A * 2/1995 Wilson ..... 70/280
5,560,658 A * 10/1996 Coolman ..... 292/28
5,636,880 A 6/1997 Miller et al. ..... 292/144
5,655,394 A * 8/1997 DiRocco ..... 70/159
5,711,558 A * 1/1998 Woody ..... 292/335
5,778,805 A * 7/1998 Green ..... 109/51
6,042,158 A * 3/2000 Horn ..... 292/165

* cited by examiner

*Primary Examiner*—Gary Estremsky
(74) *Attorney, Agent, or Firm*—Clark & Brody

(57) ABSTRACT

An electronic lock employs an electronic latch for operating the lock bolt. The lock utilizes a flexible member linked between a portion of the lock bolt and a solenoid device. Upon retraction of a solenoid driver, the flexible member pulls the deadlocking lever for latch retraction. When the flexible member is released by the driver, the bolt can extend for a subsequent opening.

18 Claims, 2 Drawing Sheets

ELECTRONIC LOCK

This application claims priority from Provisional application Ser. No. 60/133,872, filed May 12, 1999.

FIELD OF THE INVENTION

The present invention is directed to an improved electronic lock, and in particular to an electronic lock employing an electrically actuated driver and a flexible member linked to a portion of a latch assembly of the lock bolt for latch retraction.

BACKGROUND ART

In the prior art, electronic locks are known as disclosed in U.S. Pat. No. 5,636,880 to Miller et al., herein incorporated in its entirety by reference. This patent discloses an electronic lock using a ring and electrically actuated driver for lock operation. The lock of this patent is advantageous in that it can be used as a retrofit for existing locks or be manufactured as a new lock. One disadvantage of the lock of the Miller et al. patent is that the ring requires close manufacturing tolerances, thus increasing lock manufacturing cost. In addition, the number of cycles of lock operation with the ring can be less than desired for some applications. Accordingly, a need has developed to provide an improved electronic lock overcoming the disadvantages noted above.

The present invention solves this need by providing an improved electronic lock that overcomes the deficiencies present in prior art locks. In particular, the inventive lock employs a flexible member that allows for easy and efficient lock bolt retraction, thus eliminating the high tolerance machining required in prior art locks.

SUMMARY OF THE INVENTION

Accordingly, it is a first object of the present invention to provide an improved electronic lock.

Another object of the present invention is an electronic lock having high durability.

A further object of the present invention is a method of retracting a lock bolt using the inventive lock.

Other objects and advantages will be apparent as a description of the invention proceeds.

In satisfaction of the foregoing objects, the electronic lock of the present invention comprises a lock having a retractable latch assembly, an electrically actuated driver, and at least one flexible member linked between a portion of the electrically actuated driver and a portion of the retractable latch assembly. The flexible member has a length such that retraction of a portion of the electrically actuated driver retracts a retractable latch of the latch assembly of the lock for lock opening.

The lock can be a narrow stile type lock and the flexible member can be a chain, metal braided cable, ribbon, blended Kevlar/fiberglass ribbon, a coated metal cable, a solid wire or the like.

The retractable latch can include a pivot arm with one end of the flexible member secured to the pivot arm for lock operation. The pivot arm can have a bore therethrough to facilitate attachment with the flexible member. More than one flexible member can be employed and a solenoid can be used as the actuated driver. The lock can also employ a guided portion for the flexible member's travel during driver movement, with or without a radius to further facilitate movement of the cable.

The invention also includes a method of retracting a latch of a lock by actuating the electrically actuated driver to pull the flexible member. Pulling on the flexible member causes a portion of the latch assembly to retract so that the lock is in an open position for ingress or egress to an area.

DESCRIPTION OF THE PREFERRED EMBODIMENTS

The improved electronic latch is a device used to allow access through an entryway by means of electrical activation.

When energized, a solenoid, motor, or other electromechanical device retracts the latchbolt by means of an attached cable, tether, microchain or other flexible attachment.

Figure 1:
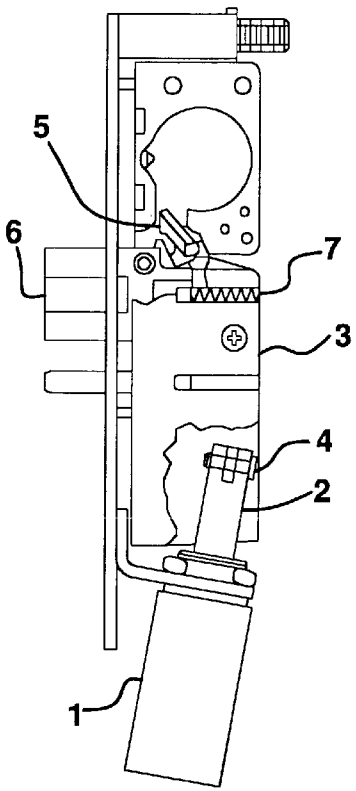
FIG. 1 is a side view of one embodiment of the inventive lock.

Referring to FIG. 1, the solenoid (1) retracts a plunger (2) to which is attached a cable (3) or other flexible member by means of a pin (4). The cable is attached to the deadlocking lever (5) that in turn pulls the latchbolt (6) into the body of the lock. When the solenoid is de-energized, a spring (7) pushes the latchbolt back into the extended position.

Figure 2C:
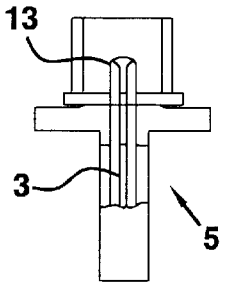
FIG. 2(C)shows a front view of the deadlocking lever of FIG. 2(B)
Figure 2B:
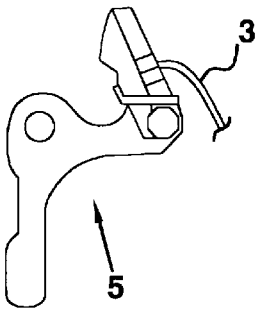
FIG. 2(B) shows a side view of the deadlocking lever removed from the lock.
Figure 2A:
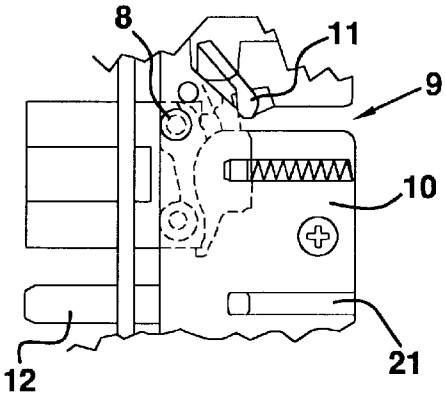
FIG. 2(A) shows a portion of the lock mechanism of the FIG. 1 embodiment.

One key element of this design is the attachment of the cable to the deadlocking lever (5). Referring to FIG. 2, the deadlocking lever is attached to the latchbolt by a pivot (8) and is guided by slot (9) cut into the chassis (10) into which rests a pin extension (11) of the deadlocking lever (5). When the deadlocking tab (12) is pushed in, the pin extension (11) is rotated into the upper portion of the slot which prevents the latchbolt from being pushed inward. The cable (3) must first pull the pin down and out of this portion of the slot, and then continue to pull the deadlocking lever (5) along the length of the slot. The cable would be typically attached to the deadlocking lever (5) by looping and insertion through a hole (13).

Figure 3:
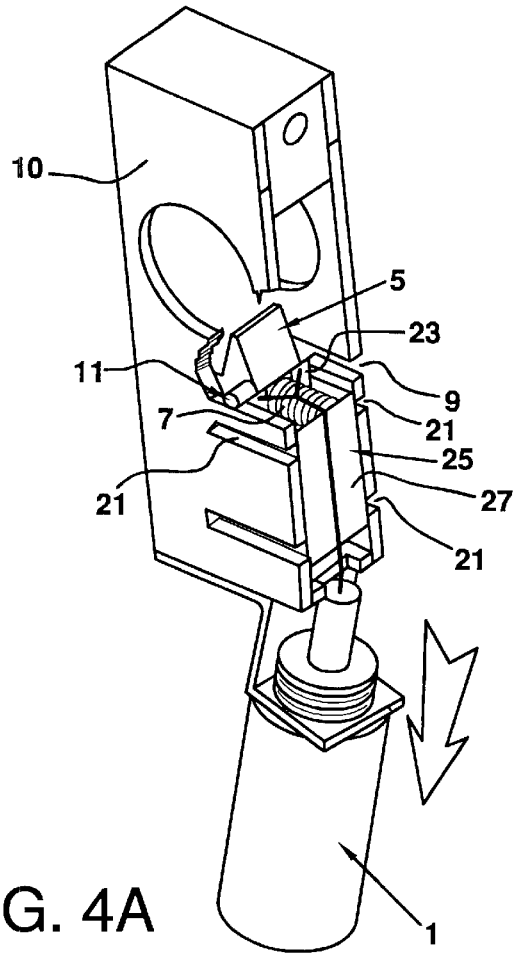
FIG. 3 shows a perspective view of the lock of FIG. 1.

FIG. 3 shows a perspective view of an exemplary lock using the flexible member. In FIG. 3, the lock chassis is designated by the reference numeral 10 and depicts the solenoid 1 as a 1"×2" pull type solenoid. Also depicted is the slot 9 which acts as a guide for the pin extension 11 of the deadlocking lever 5. The slots 21 in the chassis 10 act as guides for travel of the deadbolt/latch when moving between the extended and retracted positions.

Downward linear motion (or even rotary motion if size and force determine) retracts the plunger. The deadbolt 6 is attached to the solenoid 1 via a yoke 23 and the cable or tether 3. The connection between the solenoid and bolt can be made of Teflon, Kevlar, steel band, cable, or chain. Attachment to the bolt can be a yoke tapped into the bolt beneath the hook 5. A guide for the tether or cable 3 can be a contour plate 25 which fits within the chassis 10. The contour plate can have a smooth or polished surface 27 and can mount to the chassis in any way. The surface 27 acts as a low friction guide for the cable during its movement.

Figure 4A:
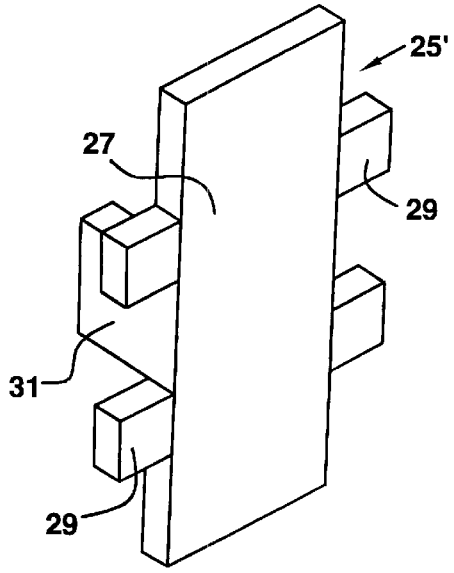
FIG. 4(A) shows a contour plate for the inventive lock.
Figure 4B:
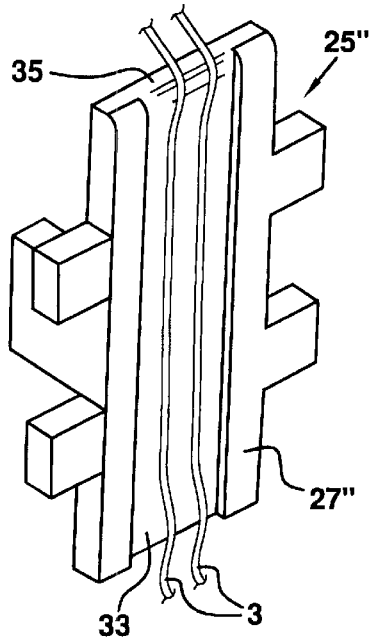
FIG. 4(B) shows another embodiment of the contour plate of FIG. 4(A)

FIGS. 4A and 4B show a contour plate and an improved contour plate, respectively, as described above. Referring to FIG. 4A, the contour plate 25' can have protrusions 29 to interface with slots 21 and protrusion 31 to interface with the chassis 10. A modified contour 25" plate is shown in FIG. 4B whereby the surface 27" has a slot 33 which better guides the cable during its travel. The plate 25' can also employ a radiused edge 35 to ease sliding action of the cable 3.

FIG. 4B also shows a pair of flexible members 3 riding in the slot 33, as opposed to the unitary member shown in FIG. 3.

The advantages of invention are:

1) Continuous linear motion. The use of a flexible cable eliminates the need for a mechanism to change the direction of force.

2) Minimal parts are needed so that there are fewer points at which mechanical wear can occur.

3) The cable & solenoid assembly configuration is not dependent upon whether the lock is used on a right hand or left-hand door.

The use of a thin cable allows for a very narrow profile which makes the lock easy to install in aluminum frame doors.

Although a solenoid is depicted, other known drivers can be used. The driver can be mounted on the lock or adjacent thereto. The flexible member can be a single member or plural members and can be any type of a wire, cable, ribbon, chain, or the like that will have sufficient strength to pull the latch repeatedly without premature failure. Although narrow stile locks are preferred, the driver and flexible member assembly can be employed in any lock where latch retraction is desired by means other than a key cylinder or the like.

As such, an invention has been disclosed in terms of preferred embodiments thereof which fulfills each and every one of the objects of the present invention as set forth above and provides a new and improved electronic lock.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. An electronic lock comprising:

a) a lock having a retractable latch assembly, the retractable latch assembly further comprising a latch bolt mounted in the lock for movement between an extended position and a retracted position, and sized to enter an opening in a door frame when in the extended position for locking, and a pivot arm, the pivot arm being pivotally mounted to the latch bolt, at least pivotal movement of the pivot arm with respect to the latch bolt causing the latch bolt to move between the extended and retracted positions;

b) an electrically actuated driver; and c) a pair of flexible members linked between a portion of the electrically actuated driver and a portion of the pivot arm, the flexible member having a length such that retraction of the portion of the electrically actuated driver retracts a latch bolt of the latch assembly via the pivot arm of the lock for lock opening.

2. The lock of claim 1, wherein the at least one flexible member is one of a metal braided cable, a ribbon, a blended kevlar/fiberglass ribbon, a coated metal cable, a solid wire.

3. The lock of claim 1, wherein the portion of the pivot arm has a bore therethrough, the least one flexible through the bore for attachment.

4. The lock of claim 1, wherein the electrically actuated driver is a solenoid.

5. The lock of claim 1, wherein the solenoid has a retractable pin, the pin linked to the at least one flexible member.

6. The lock of claim 1, wherein the lock further comprises an elongated lock chassis having a narrow width dimension adapted to be mounted in a stile of a narrow stile door, the stile having a narrow peripheral face separating opposing narrow stile members.

7. The lock of claim 1, wherein the lock has a lock chassis, and the pivot arm has at least one pin, the pin being pivotally mounted to the deadlatch bolt, the lock chassis having at least one slot therein, the slot configured to direct the pin in a first direction during rotation of the pivot arm, and a second direction for sliding movement of the pivot arm for deadlatch bolt retraction.

8. An electronic lock comprising:

a) a lock having a retractable latch assembly, the retractable latch assembly further comprising a latch bolt mounted in the lock for movement between an extended position and a retracted position, and sized to enter an opening in a door frame when in the extended position for locking, and a pivot arm, the pivot arm being pivotally mounted to the latch bolt, at least pivotal movement of the pivot arm with respect to the latch bolt causing the latch bolt to move between the extended and retracted positions;

b) an electrically actuated driver;

c) at least one flexible member linked between a portion of the electrically actuated driver and a portion of the pivot arm, the flexible member having a length such that retraction of the portion of the electrically actuated driver retracts a latch bolt of the latch assembly via the pivot arm of the lock for lock opening; and a guide plate arranged between the electrically actuated driver and the portion of the retractable latch assembly, the guide plate having a flat surface for guiding the at least one flexible member; and wherein at least one edge of the guide plate flat surface has a radiused portion to ease sliding movement of the at least one flexible member during retraction and extension of the portion of the electrically actuated driver.

9. In a door having a narrow stile comprising a narrow peripheral face separating opposing narrow stile members and a lock having an elongated lock chassis having a narrow width dimension, the elongated lock chassis mounted in between the narrow stile members so that a part of the lock can extend through an opening in a portion of the narrow peripheral face and enter an opening in an adjacent door frame for locking, the improvement comprising an electronic lock further comprising:

a) a lock having a retractable latch assembly, the retractable latch assembly further comprising a latch bolt mounted in the lock for movement between an extended position and a retracted position, and sized to enter the opening in the door frame when in the extended position for locking, and a pivot arm, the pivot arm being pivotally mounted to the latch bolt, at least pivotal movement of the pivot arm with respect to the latch bolt causing the latch bolt to move between the extended and retracted positions;

b) an electrically actuated driver; and c) at least one flexible member linked between a portion of the electrically actuated driver and a portion of the pivot arm, the flexible member having a length such that retraction of the portion of the electrically actuated driver retracts a latch bolt of the latch assembly via the pivot arm of the lock for lock opening.

10. An electronic lock comprising:

a) a lock having a retractable latch assembly, the retractable latch assembly further comprising a latch bolt mounted in the lock for movement between an extended position and a retracted position, and sized to enter an opening in a door frame when in the extended position for locking, and a pivot arm, the pivot arm being pivotally mounted to the latch bolt, at least pivotal movement of the pivot arm with respect to the latch bolt causing the latch bolt to move between the extended and retracted positions;

b) an electrically actuated driver;

c) at least one flexible member linked between a portion of the electrically actuated driver and a portion of the pivot arm, the flexible member having a length such that retraction of the portion of the electrically actuated driver retracts a latch bolt of the latch assembly via the pivot arm of the lock for lock opening; and a guide plate arranged between the electrically actuated driver and the portion of the retractable latch assembly, the guide plate having a groove for guiding the at least one flexible member; and wherein at least one edge of the guide plate flat surface has a radiused portion to ease sliding movement of the at least one flexible member during retraction and extension of the portion of the electrically actuated driver.

11. A method of retracting a latch bolt of a lock comprising:

a) providing an electrically actuated driver and a lock having a latch bolt mounted in the lock for movement between an extended position and a retracted position, and sized to enter an opening in a door frame when in the extended position for locking, and a pivot arm, the pivot arm being pivotally mounted to the latch bolt, at least pivotal movement of the pivot arm with respect to the latch bolt causing the latch bolt to move between the extended and retracted positions;

b) linking at least one flexible member between a portion of the electrically actuated driver and a portion of the pivot arm; and c) actuating the driver to retract the portion thereof and pivot the pivot arm to move the latch bolt to the retracted position for door opening, wherein the lock further comprises an elongated lock chassis having a narrow width dimension adapted to be mounted in a stile of a narrow stile door, the stile having a narrow peripheral face separating opposing narrow stile members.

12. The method of claim 11, further comprising using a solenoid as part of the electrically actuated driver.

13. The method of claim 11, further comprising using one of a metal braided cable, a ribbon, a blended kevlar/fiberglass ribbon, a coated metal cable, a solid wire as the at least one flexible member.

14. The method of claim 11, further comprising guiding the flexible member in a groove during the retraction of the portion of the electrically actuated driver.

15. The method of claim 11, further comprising using a solenoid as part of the electrically actuated driver.

16. The method of claim 14, wherein the groove is a flat surface.

17. A method of retracting a latch bolt of a lock comprising:

a) providing an electrically actuated driver and a lock having a latch bolt mounted in the lock for movement between an extended position and a retracted position, and sized to enter an opening in a door frame when in the extended position for locking, and a pivot arm, the pivot arm being pivotally mounted to the latch bolt, at least pivotal movement of the pivot arm with respect to the latch bolt causing the latch bolt to move between the extended and retracted positions;

b) linking at least one flexible member between a portion of the electrically actuated driver and a portion of the pivot arm; and c) actuating the driver to retract the portion thereof and pivot the pivot arm to move the latch bolt to the retracted position for door opening;

wherein the pivot arm first rotates and then slides as part of step (c).

18. An electronic lock comprising:

a) a lock having a retractable latch assembly, the retractable latch assembly further comprising a latch bolt mounted in the lock for movement between an extended position and a retracted position, and sized to enter an opening in a door frame when in the extended position for locking, and a pivot arm, the pivot arm being mounted to the latch bolt and in the lock for pivoting and then sliding movement to causing the latch bolt to move between the extended and retracted positions;

b) an electrically actuated driver; and c) at least one flexible member linked between a portion of the electrically actuated driver and a portion of the pivot arm, the flexible member having a length such that retraction of the portion of the electrically actuated driver retracts a latch bolt of the latch assembly via the pivot arm of the lock for lock opening.

* * * * *